United States Patent [19]

Neumayer

[11] 3,939,979

[45] Feb. 24, 1976

[54] DISPLAY CONTAINER

[75] Inventor: George Anton Neumayer, Deerfield, Ill.

[73] Assignee: Illinois Tool Works Inc., Chicago, Ill.

[22] Filed: Mar. 21, 1975

[21] Appl. No.: 561,023

[52] U.S. Cl. ..... 206/461; 206/468; 206/470

[51] Int. Cl.[2] ..... B65D 73/00

[58] Field of Search ..... 206/45.34, 461, 464–465, 206/467–468, 470

[56] References Cited

UNITED STATES PATENTS

| | | | |
|---|---|---|---|
| 2,975,889 | 3/1961 | Brown | 206/470 X |
| 3,157,280 | 11/1964 | Perdue et al. | 206/468 |
| 3,480,138 | 11/1969 | Baker | 206/461 |
| 3,812,963 | 5/1974 | Zahurange et al. | 206/468 |
| 3,891,088 | 6/1975 | Huebner | 206/468 X |

FOREIGN PATENTS OR APPLICATIONS

| | | | |
|---|---|---|---|
| 425,617 | 6/1967 | Switzerland | 206/470 |

*Primary Examiner*—William Price
*Assistant Examiner*—Steven E. Lipman
*Attorney, Agent, or Firm*—T. W. Buchman; R. W. Beart

[57] ABSTRACT

A display container with a bubble portion mounted on a base portion and adapted for easy access to products contained therein without destruction of the container. The base portion includes a flap and tab connected in seriatim at one extremity thereof, this construction being folded back beneath the remaining portion of the base and allowing the tab to protrude through the base in a position to support the bubble portion.

7 Claims, 6 Drawing Figures

DISPLAY CONTAINER

This invention relates to a container adapted for use in a display which allows products contained therein to be readily seen by the prospective purchaser.

Containers of this general class are commonly "blister" package types wherein the articles are placed on a base portion and are subsequently covered and thereby sealed therein by a heat sealable plastic material. This type of package is highly desirable by merchants and manufacturers because of its unitary, sealed configuration. However, prospective customers desiring to inspect the products contained therein are required to destroy the package in order to carefully examine the products.

Attempts to overcome this problem have resulted in slidable blister-type packages which allow ready access to the products but do not provide the structure necessary to retain the bubble on the base during normal handling prior to the placement of the package on a display.

It is, therefore, an object of the present invention to provide a display package which may be readily opened in a manner which does not destroy the package and yet provide a package which is capable of remaining closed during normal predisplay handling.

It is another object of the invention to provide a package which is capable of being provided with advertising legends which are themselves protected during normal handling procedures.

In accomplishing the above objects, the present invention includes a thermoplastic-type cover portion which includes a bubble section and a flange with at least one portion of the flange extending for a predetermined distance from the bubble section. A slidable base portion is associated beneath the cover portion. The base is provided with a flap and tab element connected in seriatim to one extremity thereof. A slot is provided inwardly from the one extremity of the base and preferably located a distance substantially equal to the predetermined distance of the flange section thus allowing the flap to be folded beneath the base so that the tab may be inserted in the slot in adjacent supporting contact with the side wall of the bubble thus retaining the cover, at least temporarily, in a closed position.

DESCRIPTION OF THE PREFERRED EMBODIMENT

Figure 1:
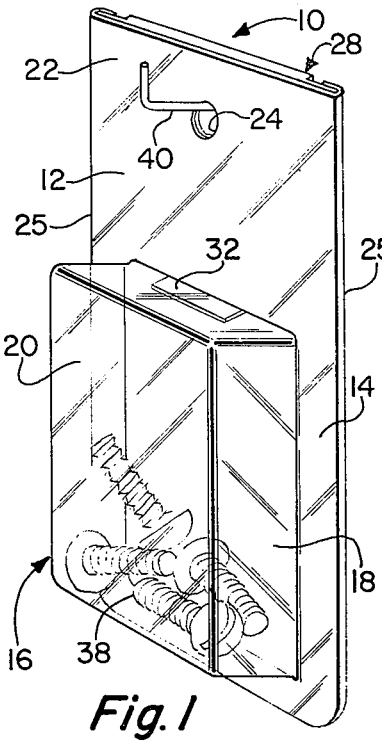
FIG. 1 is a perspective view of a preferred embodiment of the container shown in fully closed position and associated with a hook-type display.

As illustrated in FIGS. 1–4 of the drawings, the container 10 basically includes a transparent plastic cover portion 12 and a slidable base portion 28, preferably of a rectangular sheet material, such as cardboard, and of sufficient thickness to retain its shape. The cover includes a bubble portion 16 formed upwardly from a surrounding flange 14 of generally planar configuration. The bubble typically will include side walls 18 and a top wall 20 spaced a predetermined distance from the base. The flange preferably extends away from the bubble a greater predetermined distance in one direction, terminating at edge 23, than in the other directions. This extended flange portion 22 will thus form the hanging and display portion of the container in a manner to be described later herein.

The base 28 is slidably associated beneath the cover portion through the use of lower flange sections 26 integral with the cover and which are located on the side edges 25 and one end extremity 27 of the cover. These flange sections 26, in cooperation with the upper flange 14, provide opposing marginal surface areas at the sides of the cover and at one extremity to guide and retain the base beneath the cover and provide a stop restricting the movement of the base relative to the cover in one direction.

Figure 2:
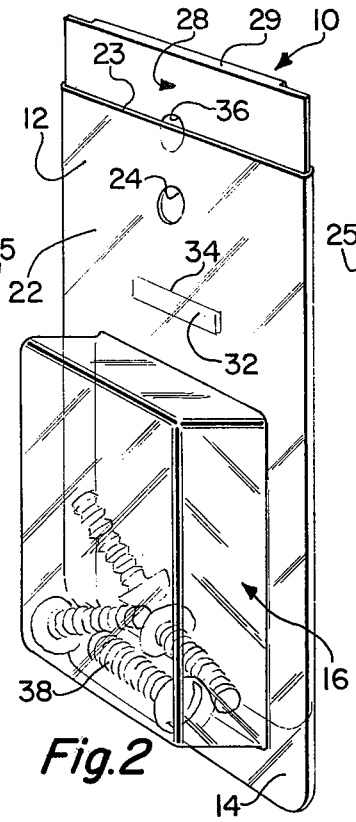
FIG. 2 is a perspective view of the preferred embodiment of the container, removed from the display, and showing the base portion in a partially open position.
Figure 3:
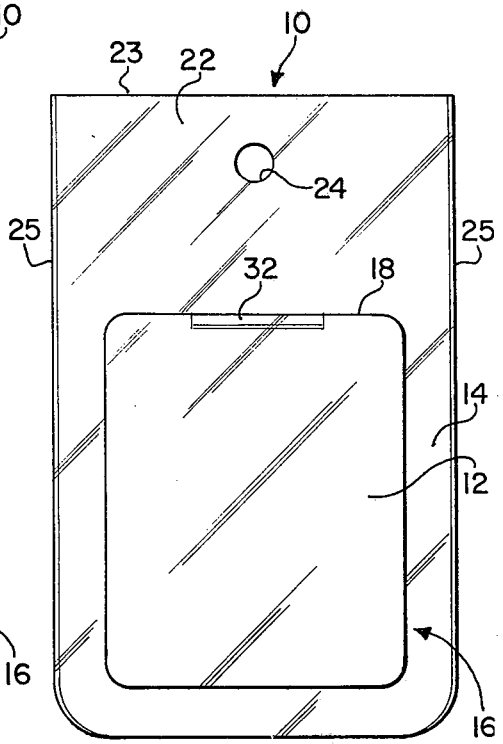
FIG. 3 is a top plan view of the container.

As shown in FIG. 2, a purchaser desiring to closely inspect articles 38 contained in the bubble portion may do so merely by removing the container from the display and sliding the base portion relative to the cover portion in the direction shown in FIG. 2. Such a movement thus opens the cavity formed by the bubble for easy access to the displayed articles without permanently destroying the container.

Figure 5:
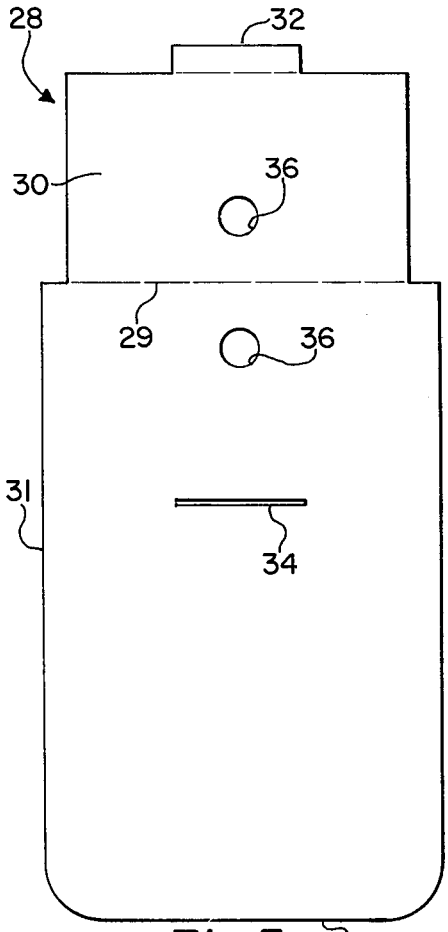
FIG. 5 is a top plan view of the base portion in its fully extended position prior to association with the cover portion.
Figure 6:
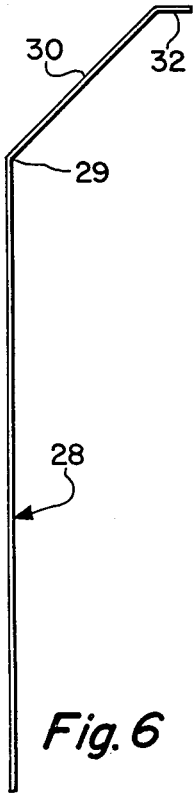
FIG. 6 is an end view of the base showing the pivotal movements of the flap and tab elements in preparing the base for association with the cover.
Figure 4:
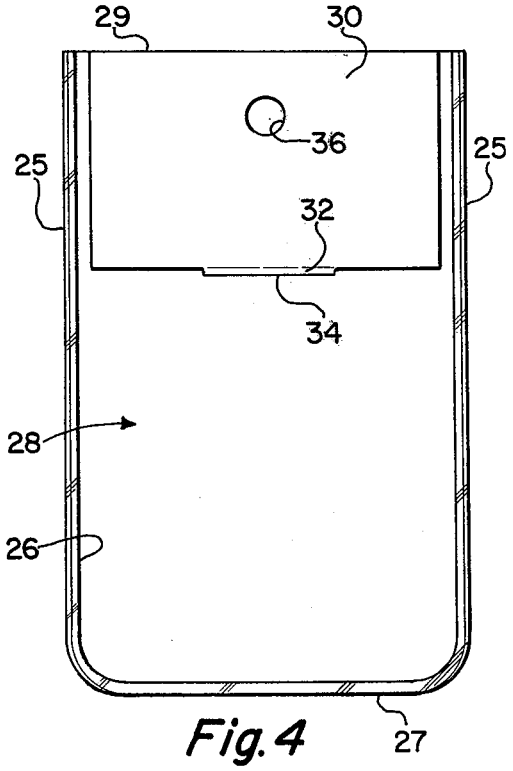
FIG. 4 is a bottom plan view of the container.

Turning now to FIGS. 5 and 6, the novel configuration of the base portion 28 will be described in more detail. The base portion is generally rectangular in shape and defined by side edges 31, terminal edge 33 and bend line 29 and is of generally the same perimetrical dimension and configuration as the cover portion with which it is associated.

A flap portion 30 and tab portion 32 are connected in seriatim to the base at the extremity thereof defined by bend line 29. The flap is preferably of a width less than the width of the base portion defined between side edges 31 and the tab is of a width preferably less than the width of the flap. A slot 34 is formed inwardly from the extremity defined by bend line 29 and the distance from the slot 34 to the bend line 29 is preferably a distance equal to the predetermined extent of portion 22 of the flange for a purpose to be described later.

The base 28 is readily manipulated into its operative configuration by bending the flap 30 about the bend or pivot line 29 to superimpose the rear face of the base and allowing the tab 32 to be inserted in the slot 34.

The temporary retention against accidental movement of the base relative to the cover while in the closed position is primarily obtained by the interaction of the tab 32 against a side wall 18 of the bubble. It will be noted in FIGS. 3 and 4 that free sliding movement of the base relative to the cover is precluded in one direction by the lower flange portion 26 and the end extremity 27 and in the other direction by the supporting adjacency of the tab 32 to the side wall 18. Accessibility, without destroying the container, may be obtained by merely removing the tab 32 from the slot 34 and, in part, reversing the assembly process described relative to the base in FIGS. 5 and 6. This removal of the tab is facilitated by dimensioning the width of the flap to be less than the width of the base thus permitting pivotal movement of the flap without interference from the lower flange portion 26. Once the tab has been removed, then the base will be free to move in the opening direction.

Of course, the package may be alternately opened in a manner which does not require the hand manipulation of the tab 32. In such a procedure which is shown in FIG. 2, the base is manually slid relative to the cover portion with a force great enough to depress the tab allowing it to slide beneath the side wall and under portion 22 of the flange.

The association of the package with an appropriate display such as those utilizing a hook 40 is facilitated through the use of aligned holes 24 and 36 in the cover and base portions respectively. Holes 36 may be formed in the base portion and flap portion so that all of these holes are properly aligned when the base is in its fully closed position on the cover. Since the hook will bear against both the base portion and the cover portion, the weight of the articles 38 in the bubble will not permit movement of one portion relative to the other when in the display condition. It should be noted also that flange portion 22 provides a protective covering for any advertising legends that may wish to be placed on the base portion in that area.

It should be understood that the structure described may provide a package which could be reusable after an initial opening which could be advantageous to a consumer in storing unused products.

It should now be clear that the invention provides a package which is readily and nondestructibly accessible to selective removal of articles, such as miscellaneous hardware articles, and yet is of such a structure that will prevent disassociation or sliding of the cover relative to the base during normal handling operations.

While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A display container adapted to hang from a rack, including a cover portion with a bubble section having upstanding wall sections and a top wall section, a flange section at least partially surrounding the bubble section, a portion of said flange section extending for a predetermined distance in a given direction from the wall sections, a generally rectangular base portion slidably associated with and beneath the cover portion and having perimetrical dimensions substantially identical to the perimetrical dimensions of the cover portion, the surrounding flange section of the cover portion including reversely bent portions providing spaced opposing marginal surface areas adjacent opposing side edges of the cover and one end edge facilitating the sliding association and retention of the base portion beneath the cover portion, a pivotable flap element and tab element connected in seriatim and integral with one end extremity of the base portion thereby adapted to bend and underlie a segment of the base portion, the flap element being of a length at least equal to said predetermined dimension of the flange section, a slot means in the base portion located inwardly of one end thereof so that the flap portion may be bent beneath the base portion and the tab inserted through the slot in supporting adjacency to an inner peripheral upstanding wall section of the bubble section to temporarily retain the base portion in a closed position beneath the cover portion.

2. A container according to claim 1, wherein the base portion and flap element thereof and said portion of the flange section extending for a predetermined distance being provided with apertures which are aligned when the base portion is in a closed position beneath the cover portion.

3. A container according to claim 1, wherein the flange section totally surrounds the bubble section.

4. A container according to claim 1, wherein the slot is spaced substantially said predetermined distance from the end extremity of the base portion which is associated with the pivotable flap element.

5. A container according to claim 1, wherein the cover portion is of a generally transparent thermoplastic material.

6. A container according to claim 1, wherein the flap element is of less width than the width of the base portion.

7. A container according to claim 6, wherein the tab element is of less width than the width of the flap element.

* * * * *